United States Patent [19]

Kolosov

[11] 4,123,954

[45] Nov. 7, 1978

[54] DEVICE FOR LONGITUDINAL CUTTING OF THERMO-SOFTENING MATERIALS INTO STRIPS

[76] Inventor: Ivan A. Kolosov, ulitsa Astrakhanskaya 118, kv. 54, Saratov, U.S.S.R.

[21] Appl. No.: 831,495

[22] Filed: Sep. 8, 1977

[51] Int. Cl.[2] ..... B26D 3/12; B26D 7/10

[52] U.S. Cl. ..... 83/171; 83/482; 83/508

[58] Field of Search ..... 83/171, 482, 508

[56] References Cited

U.S. PATENT DOCUMENTS

| | | | |
|---|---|---|---|
| 2,003,404 | 6/1935 | Valentine | 83/482 X |
| 2,395,950 | 3/1946 | Wolf | 83/482 |
| 3,041,907 | 7/1962 | Gallagher, Jr. | 83/482 |
| 3,225,634 | 12/1965 | Becker | 83/171 |

*Primary Examiner*—J. M. Meister

*Attorney, Agent, or Firm*—Lackenbach, Lilling & Siegel

[57] ABSTRACT

A device for longitudinal cutting of a thermo-softening material into strips, such as strips of a separating material for battery electrodes comprising a roll holder, two pulling rollers having their rotation drive installed parallel and near to said roll holder, and said rollers moving the band in the course of cutting and delivering the cut strips onto the receiving shafts of a wind-up mechanism. A common shaft parallel to the pulling rollers is located under a cutting mechanism and carries electric cutters secured on arms; the hubs of said arms are fastened with the aid of intermediate sleeves on said common shaft. Both the hub and the intermediate sleeve are provided with segment teeth which interact with each other during the turning of the common shaft thereby lifting automatically the electric cutters.

1 Claim, 2 Drawing Figures

United States Patent [19]

Kolosov

[11] 4,123,954

[45] Nov. 7, 1978

[54] DEVICE FOR LONGITUDINAL CUTTING OF THERMO-SOFTENING MATERIALS INTO STRIPS

[76] Inventor: Ivan A. Kolosov, ulitsa Astrakhanskaya 118, kv. 54, Saratov, U.S.S.R.

[21] Appl. No.: 831,495

[22] Filed: Sep. 8, 1977

[51] Int. Cl.[2] ..... B26D 3/12; B26D 7/10

[52] U.S. Cl. ..... 83/171; 83/482; 83/508

[58] Field of Search ..... 83/171, 482, 508

[56] References Cited

U.S. PATENT DOCUMENTS

| | | | |
|---|---|---|---|
| 2,003,404 | 6/1935 | Valentine | 83/482 X |
| 2,395,950 | 3/1946 | Wolf | 83/482 |
| 3,041,907 | 7/1962 | Gallagher, Jr. | 83/482 |
| 3,225,634 | 12/1965 | Becker | 83/171 |

*Primary Examiner*—J. M. Meister

*Attorney, Agent, or Firm*—Lackenbach, Lilling & Siegel

[57] ABSTRACT

A device for longitudinal cutting of a thermo-softening material into strips, such as strips of a separating material for battery electrodes comprising a roll holder, two pulling rollers having their rotation drive installed parallel and near to said roll holder, and said rollers moving the band in the course of cutting and delivering the cut strips onto the receiving shafts of a wind-up mechanism. A common shaft parallel to the pulling rollers is located under a cutting mechanism and carries electric cutters secured on arms; the hubs of said arms are fastened with the aid of intermediate sleeves on said common shaft. Both the hub and the intermediate sleeve are provided with segment teeth which interact with each other during the turning of the common shaft thereby lifting automatically the electric cutters.

1 Claim, 2 Drawing Figures

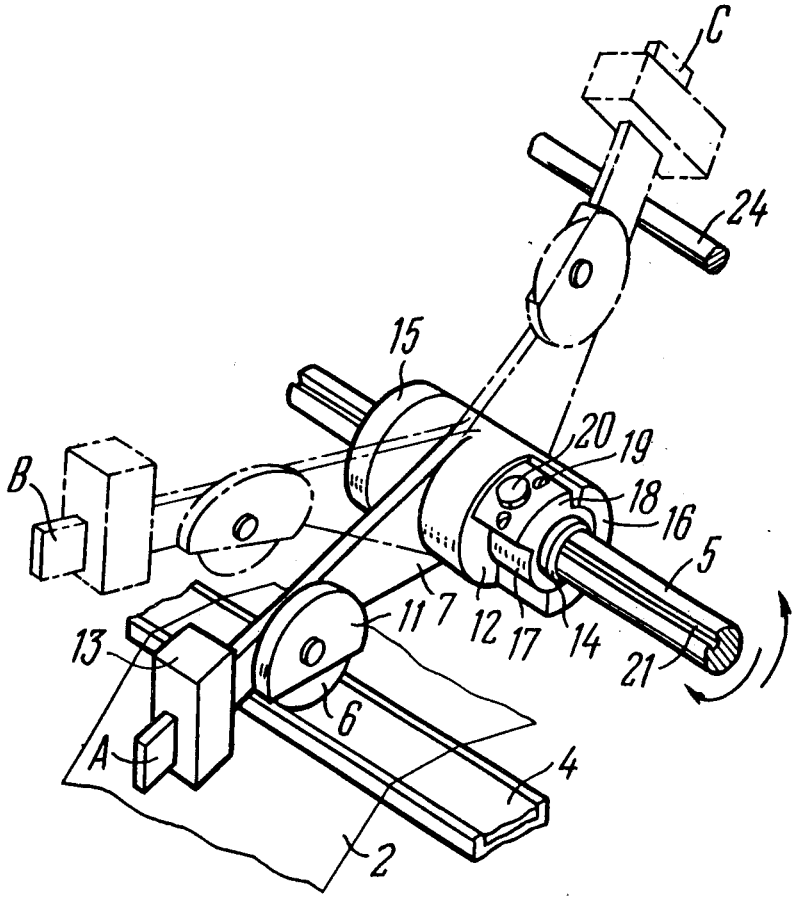

Figure 1:
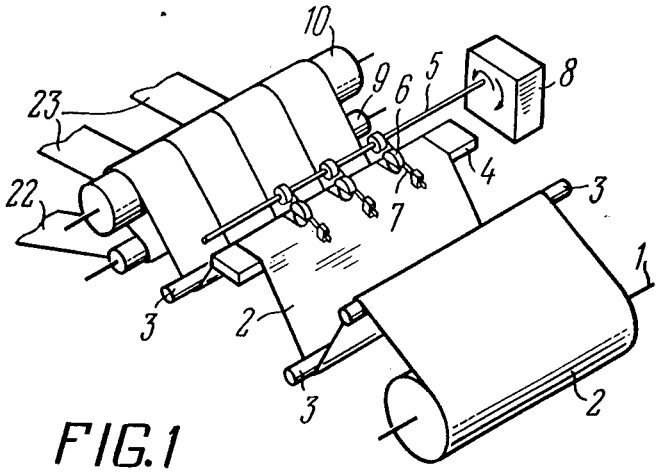
Figure 2:
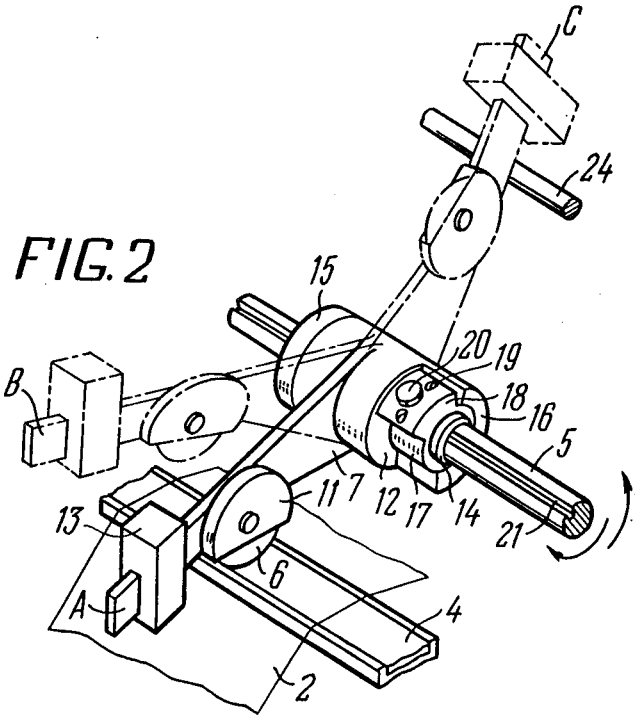

device can be used in both large and small-scale production. To change the width of the strips the locking screw 20 is loosened and the sleeve 14 is moved to the required position on the shaft 5. Thereafter, the screw 20 is tightened on the shaft 5 so as to hold the sleeve 14 in its new position, and all of the subsequent manipulations with the arms 7 take place without disturbing the initial setting.

The device for longitudinal cutting of a thermo-softening material into strips ensures automation of the longitudinal cutting of thermo-softening bands 2 of thin low strength separating materials into strips, particularly in the mechanized application to battery electrodes by providing the cutting mechanism in the form of a plurality of arms with electric cutters 6 whose hubs 12 have a segment tooth 16 on a surface face and are mounted on the shaft 5 with the aid of an intermediate sleeve 14. The sleeve 14 has a mating segment tooth 18 and is secured on the shaft 5 along the line of cut, and it permits lifting automatically all of the electric cutters 6 from the cutting zone (position "A") on stopping of the band 2 by the interaction of the segment teeth 16, 18 caused by the drive 8 rotating the shaft 5. Automatic lifting of the electric cutters 6 (on stopping of the device) to position "B" prevents melting of the material around the heated electric cuttter 6 when the band 2 stops which improves the quality of the produced strips 22, 23 and permits decreasing the allowances for the width of the strips (intended for application to the electrodes) thus economizing the separating material.

Besides, such a construction of the fastening of the electric cutters 6 allows any one of the cutters 6 to be shifted to an inoperative position "C" for periodical removal of carbon deposits without disturbing the initial setting of the width of the strips being cut which also improves the quality of the strips 23, 24. The fastening unit of the electric cutters 6 also permits prompt resetting of the device for cutting strips of a different width by partial replacement of some of the electric cutters. This is done when the electric cutters are in the inoperative position "C" and have been reset in advance for the various new strip widths, thus enabling the device to be used both in large- and small-scale production.

What we claim is:

1. A device for longitudinal cutting of a thermo-softening material, such as a band of a separating material for battery electrodes comprising: a common shaft; a roll holder disposed parallel to said shaft; a cutting mechanism with at least one electric cutter mounted on said common shaft; at least two rotatable pulling rollers disposed parallel to said common shaft to ensure movement of said band in the course of cutting said material; an arm carrying said electric cutter having a hub, and said hub being freely mounted by means of an intermediate sleeve adjustably fastened to said common shaft along the line of cut; said hub having a segment tooth on a surface face and said intermediate sleeve having a mating segment tooth, and said teeth lifting said electric cutter automatically upon interaction of said segment teeth on the turning of said common shaft in a predetermined direction.

* * * * *